US008311430B2

(12) United States Patent
Tsukamura et al.

(10) Patent No.: US 8,311,430 B2
(45) Date of Patent: Nov. 13, 2012

(54) TRANSFER DEVICE AND IMAGE FORMING APPARATUS

(75) Inventors: Shinichi Tsukamura, Uenohara (JP); Kazuteru Ishizuka, Saitama (JP)

(73) Assignee: Konica Minolta Business Technologies, Inc. (JP)

( * ) Notice: Subject to any disclaimer, the term of this patent is extended or adjusted under 35 U.S.C. 154(b) by 300 days.

(21) Appl. No.: 12/822,663

(22) Filed: Jun. 24, 2010

(65) Prior Publication Data

US 2010/0329715 A1 Dec. 30, 2010

(30) Foreign Application Priority Data

Jun. 24, 2009 (JP) ..... 2009-149695

(51) Int. Cl.
*G03G 15/16* (2006.01)
*G03G 15/00* (2006.01)
*G03G 15/20* (2006.01)

(52) U.S. Cl. ..... 399/66; 399/45; 399/314

(58) Field of Classification Search ..... 399/45, 399/66, 314
See application file for complete search history.

(56) References Cited

U.S. PATENT DOCUMENTS 5,857,132 A * 1/1999 Mizuishi et al. ..... 399/66
8,185,007 B2 * 5/2012 Tsukamura et al. ..... 399/66

FOREIGN PATENT DOCUMENTS

JP 10-240032 A 11/1998

* cited by examiner

*Primary Examiner* — Joseph S Wong
(74) *Attorney, Agent, or Firm* — Cantor Colburn LLP

(57) ABSTRACT

A transfer device comprising: a transfer section which forms a nip portion between the transfer section and an image carrier and transfers a toner image on an image carrier onto a sheet passing through the nip portion; an application section which applies a voltage to the transfer section; a determining section which determines a timing of applying voltage from the application section to the transfer section, wherein the control section controls the application section to apply a voltage having an opposite polarity to a transfer polarity to the transfer section until the timing determined by the determination section in a period since a leading edge of the sheet in a conveyance direction advances into the nip portion until a predetermined non image area of the sheet has passed through the nip portion, and then, at a timing determined, switch to apply a voltage having the transfer polarity.

19 Claims, 6 Drawing Sheets

TRANSFER DEVICE AND IMAGE FORMING APPARATUS

RELATED APPLICATION

This application is based on Japanese Patent Application No. 2009-149695 filed on Jun. 24, 2009 in Japanese Patent Office, the entire content of which is hereby incorporated by reference.

FIELD OF THE INVENTION

The present invention relates to a transfer device and an image forming apparatus.

BACKGROUND OF THE INVENTION

An image forming apparatus of an electro photography system has a transfer device which transfers a toner image formed on the image carrier (for example, a photoreceptor, an intermediate transfer member, etc.) onto a sheet. There are some which have adopted a contact transfer system which contacts a transfer roller or a transfer belt onto a sheet as a transfer device for transferring a toner image onto the sheet.

FIG. 8 is an explanatory view showing a transfer area of a contact transfer system. The contact transfer system shown in FIG. 8 presses a transfer belt B to a photoreceptor K with a transfer roller T to form a transfer nip portion N between the photoreceptor K and the transfer belt B. In case when transferring a toner image formed on the photoreceptor K onto a sheet S which advances into the transfer nip portion N, voltage (transfer voltage) having a polarity which is opposite to the polarity of toner is applied to a transfer roller T to move the toner onto the sheet S from the photoreceptor K. For example, in case where the toner has a minus polarity, transfer voltage of a plus polarity is applied to the transfer roller T.

By the way, as shown in FIG. 8, in cases where the sheet S which has burrs X at the leading edge of the conveyance direction is advanced into the transfer nip portion N and the transfer voltage is applied to the transfer roller T, the direction of an electric field points toward the photoreceptor K from the transfer roller T. Therefore, electric discharge occurs in the opening which is formed at the leading edge of the sheet between the transfer belt B and the sheet S, and the edge of the sheet S in the conveyance direction is charged with the same polarity of the transfer voltage. As a result, the leading edge of the sheet S sticks to the photoreceptor K charged with an opposite polarity of the transfer voltage, and poor separation that the sheet S winds around the photoreceptor K occurs.

Then, technology for preventing poor separation of a sheet even in case where there is a burr at the edge of the sheet in the conveyance direction has been proposed.

The technology disclosed in Unexamined Japanese Patent Application Publication No. H10-240032 is a technology for providing the portion to which the transfer voltage is not applied in a predetermined area starling from the leading edge of the sheet in the conveyance direction. According to this technology, it is possible to prevent poor separation, because discharges do not occur even though there is a burr on the leading edge of the sheet in the conveyance direction and the sheet S does not wind around the image carrier (Unexamined Japanese Patent Application Publication No. H 10-240032 discloses a case in which the image carrier is an intermediate transfer drum).

According to the technology disclosed in Unexamined Japanese Patent Application Publication No. H10-240032, the applied voltage in the predetermined area of the leading edge of a sheet in the conveyance direction is 0V (or the voltage value is close to 0V), and although the sheet has a burr, discharge seldom occurs. However, the polarity of the leading edge of the sheet in the conveyance direction does not become the polarity which repels with an image carrier. Therefor; as shown in FIG. 8, when there is a gap between the transfer belt B and the leading edge of sheet S, the leading edge of sheet S will be hard to be adsorbed by the transfer belt B but the leading edge of the sheet S will be easily stacked to the photoreceptor K. Therefore, according to the technology disclosed in Unexamined Japanese Patent Application Publication No. H10-240032, the poor separation cannot be fully prevented.

An object of the present invention is to provide a transfer device and an image forming apparatus which are capable of preventing poor separation and fully secure the density of a toner image to be transferred onto a sheet.

SUMMARY OF THE INVENTION

One aspect of the present invention is to provide a transfer device comprising: a transfer section for transferring a toner image on an image carrier onto a sheet passing through a nip portion which is formed between the transfer section and the image carrier; an application section for applying a voltage to the transfer section; a determination section for determining a timing of applying voltage to the transfer section; and a control section for controlling the application section, wherein the control section controls the application section to apply a voltage having an opposite polarity to a transfer polarity to the transfer section since a leading edge of the sheet in a conveyance direction advances into the nip portion until a predetermined non image area of the sheet has passed through the nip portion, and then switch to apply a voltage having the transfer polarity from the voltage having the opposite polarity to the transfer section while a non image area of the sheet passes through the nip portion.

Another aspect of the present invention is to provide a control method of a transfer device which comprises a transfer section for transferring a toner image on an image carrier onto a sheet passing through a nip portion which is formed between the transfer section and the image carrier and an application section for applying voltage to the transfer section, the control method comprising: controlling the application section to apply a voltage having an opposite polarity to a transfer polarity to the transfer section since a leading edge of the sheet in a conveyance direction advances into the nip portion until a predetermined non image area of the sheet has passed through the nip portion; and then controlling the application section to switch to apply a voltage having the transfer polarity from the voltage having the opposite polarity while a non image area of the sheet passes through the nip portion.

BRIEF DESCRIPTION OF THE DRAWING

These and other objects, advantages and features of the invention will become apparent from the following description thereof taken in conjunction with the accompanying drawings in which.

DESCRIPTION OF THE PREFERRED EMBODIMENT

The Outline of an Image Forming Apparatus

Figure 1:
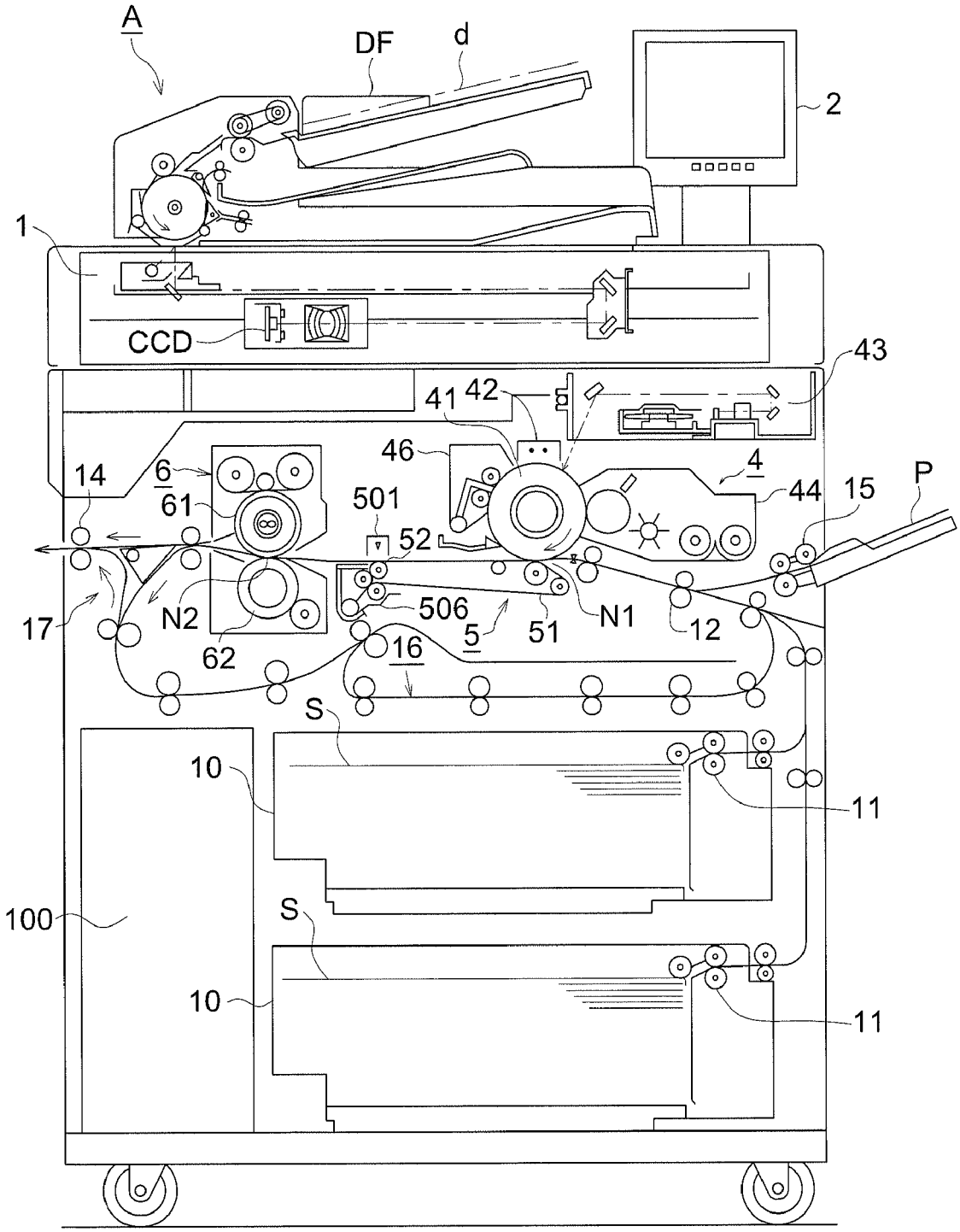
FIG. 1 illustrates a central sectional view of an image forming apparatus.

FIG. 1 illustrates a central sectional view of an image forming apparatus. The Image forming apparatus shown in FIG. 1 comprises an automatic document feed apparatus DF, an image reading section 1, an operation display section 2, an image forming section 4, a transfer section 5, a fixing section 6 and a sheet conveyance system.

The image forming section 4 comprises a photoreceptor (an image carrier) 41, a charging section 42, an exposure section 43, a development section (a developing device) 44, and a photoreceptor cleaning section 46. The paper sheet conveyance system comprises a paper sheet feeding cassette 10, a first feed section 11, second feed section 12, a paper sheet ejection section 14, a manual feeding section 15, re-feed section 16 and a reversal paper sheet ejection section 17.

A document "d" placed on the document table of the automatic document feed apparatus DF is conveyed by a paper sheet feeding device. The images of one side of the document "d" or both sides are read by the optical system of the image reading section 1, and they are read by an image sensor CCD. In an image processing section (not shown), analog processing, an A/D conversion, a shading compensation and image-compression processing are performed with the analog signal into which the image sensor CCD has converted the optical image signal. After that the image signal is transmitted to the exposure section 43.

In the image forming section 4, against the photoreceptor 41, an electric charge (it will be a negative charge in the case of an embodiment of the present invention) is added by the charging section 42, and an electrostatic latent image is formed by the laser beam irradiated from the exposure section 43. Then, an electrostatic latent image is developed by the development device 44, and it becomes a toner image (it will be a negative electric charge in the case of an embodiment of the present invention).

Subsequently, a sheet S accommodated in the paper sheet feeding cassette 10 is conveyed from the first feed section 11, and the synchronization with the toner image is taken with a registration roller. The traveling position of the leading edge of the sheet S is detected by a sheet detection sensor, and the information is transmitted to the control section 100. The entry timing to the transfer nip portion N1 formed between the transfer section 5 and the photoreceptor 41 is calculated.

Then, the toner image is transferred onto the sheet S in the transfer nip portion N1, and the sheet S electro-statically absorbed onto the transfer belt 51 is conveyed. While an anti-static is performed by a corona discharge from a separation anti-static pole 501, curvature separation is performed with a separation roller 52, and the sheet S on transfer belt 51 is conveyed to the fixing section (a fixing device) 6.

The fixing nip portion N2 formed by the fixing roller 61 and the pressing roller 62 in the fixing section 6 fixes the toner image onto a sheet. After the fixing operation, the paper sheet ejection section 14 ejects the sheet S out of the apparatus.

The toner of transfer residue on the photoreceptor 41 is removed by the photoreceptor cleaning section 46. The untransformed toner on the transfer belt 51 is removed by a belt cleaning section 506.

In the case of double-sided printing, the sheet S onto which image formation has been performed onto the first side is sent into a re-feed section 16, is switch backed and reversed. After image formation onto the second side in the image forming section 4, the sheet S is ejected by the paper sheet ejection section 14 out of the apparatus. After the sheet S branched from the usual sheet ejection passage in reversal sheet ejection is switched back and rear surface inversion is performed in a reversal paper sheet ejection section 17, the sheet S is ejected out of the apparatus by the paper sheet ejection section 14.

The image forming apparatus A of an embodiment of the present invention is to form a monochrome image on sheet S. However, the image forming apparatus A may be an image forming apparatus having a configuration which transfers a color image formed on an intermediate transfer member onto the sheet S.

[Outline of Transfer Section]

Figure 2:
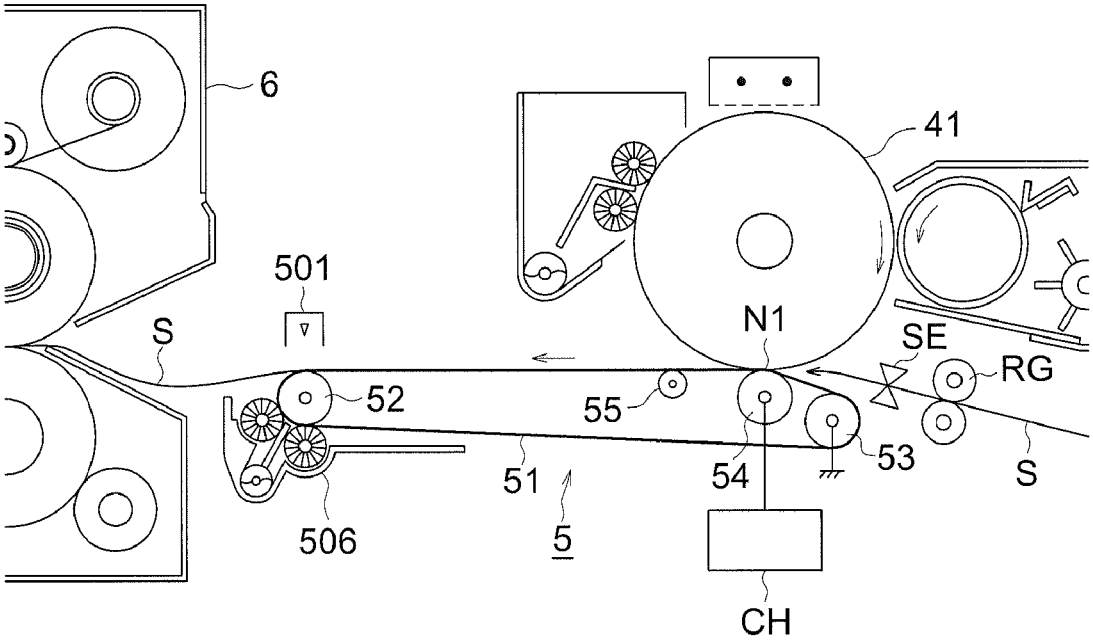
FIG. 2 illustrates an expanded sectional view of a transfer section circumference.

FIG. 2 is an expanded sectional view of the transfer section 5 circumference.

As for transfer section 5, a transfer belt 51 is stretched with a separation roller 52 structured by stainless steel (SUS), driven rollers 53 and 55 structured by an aluminum alloy and transfer roller 54 structured by foaming urethane. The separation roller 52 bears a function as a driving roller and transmits driving force of a drive motor to the transfer belt 51 by being connected with a drive motor via an unillustrated connection gear. For example, the transfer belt 51 is driven with conveyance speed (nm) of 200-600 mm/sec. In order to increase a friction coefficient to the surface of the separation roller 52, rubber coating is performed onto the surface of the separation roller 52.

Transfer belt 51 is structured by, for example, resin materials, such as, polyimide (PI), poly vinylidene fluoride (PVDF) and an ethylenic copolymer (ETFE), rubber materials, such as polyurethane rubber into which conductive fillers, such as, carbon has been distributed for resistance adjustment, or a material which contains an ionicity-electric-conduction material.

A transfer power supply CH which functions as an application section is connected to the transfer roller 54. When transferring a toner image on the photoreceptor 41 onto the sheet S, transfer voltage having an opposite polarity to the toner is applied to the transfer roller 54. In an embodiment of the present invention, since the toner has a minus polarity, transfer voltage of a plus polarity is applied to the transfer roller 54, and a transfer electric field is formed.

The separation anti-static electrode 501 is an anti-static electrode which performs a corona anti-static, and is arranged in a position opposing the separation roller 52. The separation anti-static electrode 501 is a needlelike electrode (it is also called a serration electrode). For example, by performing an etching process of the SUS board of 0.1 mm thickness, the peaks which are accumulation portions are arranged at a constant pitch across the passing paper sheet width direction at intervals of about 1-5 mm. Voltage, which is formed by direct-current voltage having an opposite polarity to a bias miler or the same direct-current voltage, onto which alternating current voltage has been superimposed, is applied to the needlelike electrode. A separation anti-static electrode using electric discharge wires, such as, tungsten, may be used instead of the needlelike electrode.

In order to transfer a toner image onto a proper area (imaging area) of the sheet S, the registration roller RG synchronizes the sheet S, which advances into the transfer nip portion N1, with the toner image on photoreceptor 41. The leading edge of the sheet S is detected by the sheet detection sensor SE. Based on a detection signal of the sheet detection sensor SE, voltage applied to the transfer roller 54 is controlled by the control section 100.

[Block Diagram of Control System in Image Forming Apparatus]

Figure 3:
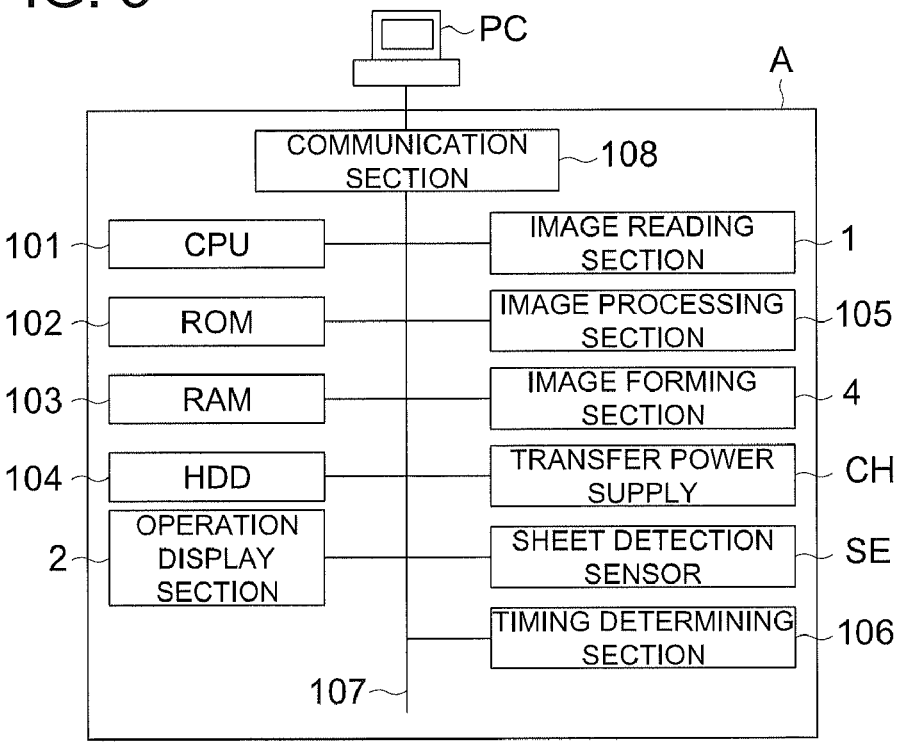
FIG. 3 illustrates a block diagram of a control system of the image forming apparatus.

FIG. 3 is a block diagram of a control system of the image forming apparatus A, and shows only a main portion of the apparatus here. CPU (Central Processing Unit) 101 is connected to ROM (Read Only Memory) 102 or RAM (Random Access Memory) 103 via system bath 107. This CPU 101 reads various programs stored in the ROM 102, expands them in the RAM 103 and controls operations of each section. The CPU 101 executes various processing according to the programs expanded in the RAM 103, stores the processing result in the RAM 103 and displays them on the operation display section 2. Then, the CPU 101 stores the processing result stored in the RAM 103 to a predetermined storage place. In an embodiment of the present invention, the control section 100 is configured so that the CPU 101 collaborates with the ROM 102 and the RAM 103.

The ROM 102 memorizes programs and data in advance and typically comprises a semiconductor memory.

The RAM 103 forms the work area which temporarily memorizes data which were processed by various programs executed by the CPU 101.

A HDD 104 has a function to memorize image data of a document image read and obtained by the image reading section 1, or to memorize outputted image data. The HDD 104 has a structure having an overlapped metal disc disk onto which magnetic particles have been coated or vapor-deposited. The metal disc is rotated at a high speed by a motor, and a magnetic head is closely brought to the metal disc to read and write data onto or from the metal disc.

The operation display section 2 enables various kinds of setups. The operation display section 2 acts as, for example, a touch-panel system. When a user inputs an instruction through the operation display section 2, conditions with respect to the image formation are set up. Various kinds of information, including information on a network setup is displayed on the operation display section 2.

The image reading section 1 optically reads a document image, and converts it into an electric signal. Image processing of image data generated by the image reading section 1 and the image data which has been transmitted from PC connected to the image forming apparatus A and received by a communication section 108 are processed by the image processing section 105.

The image forming section 4 receives image data onto which image processing has bee performed by the image processing section 105 and forms an image on a sheet.

A transfer power supply CH is controlled by the control section 100 configured by CPU 101 and so on, and the polarity of the transfer voltage is changed based on the detection signal of the sheet detection sensor SE. The transfer device in an embodiment of the present invention is configured at least by the transfer section 5, the transfer power supply CH and the control section 100.

A timing determining section (determining section) 106 determines a timing of applying voltage which is applied to the transfer roller 54 by the transfer power supply CH. The timing determining section 106 includes an adjusting section for adjusting a parameter for adjusting a timing of applying voltage and determines the timing according to the parameter. As the details will be described later, the timing determining section determines the timing of applying the voltage having an opposite polarity to the transference polarity to the transfer roller 54, the timing of switching from the voltage having an opposite polarity to the transference polarity to the voltage having the transference polarity, and so on.

[Control of Transfer Power Supply]

As explained in FIG. 2, the transfer power supply CH is connected to the transfer roller 54, and a certain voltage is applied to the transfer roller 54. In order not to wind the sheet S around the photoreceptor 41 although a burr have been generated at the leading edge of the conveyance direction of the sheet S which advances into transfer nip portion N1 to prevent poor separation, and in order to fully secure the density of the toner image transferred onto the sheet S, voltage applied to the transfer roller 54 from the transfer power supply CH is adjusted. This adjustment operation will be explained in detail using FIGS. 4 and 5.

Figure 4:
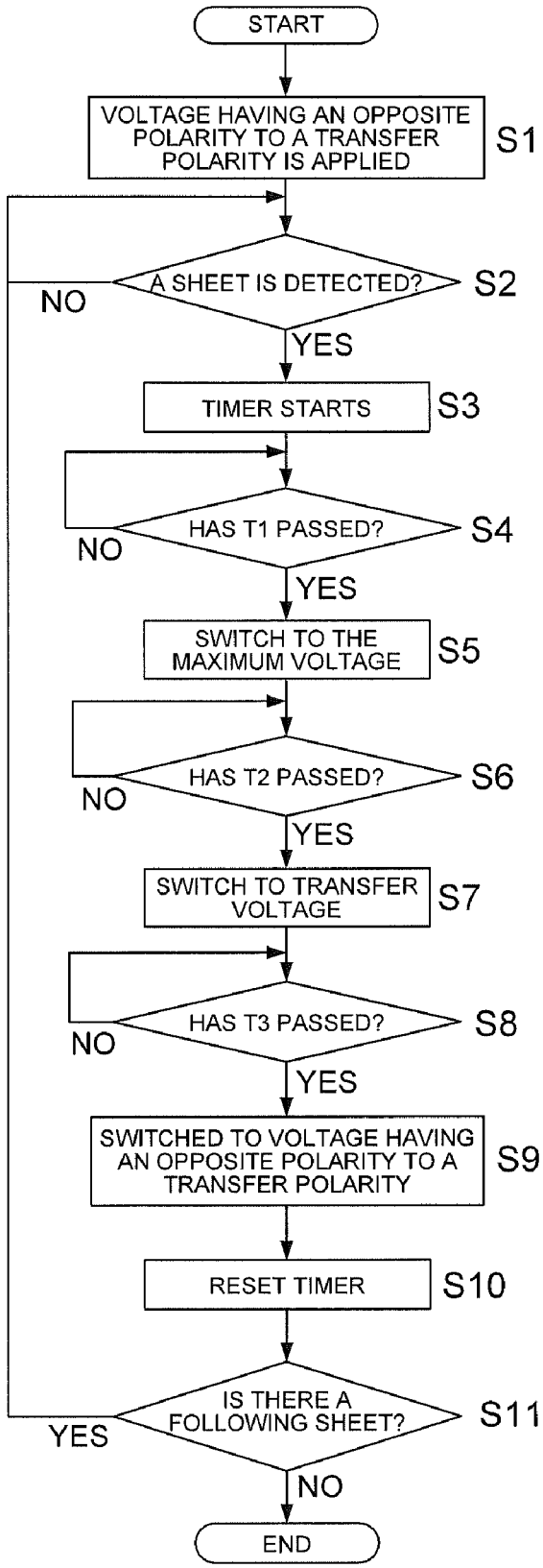
FIG. 4 illustrates a flow chart with respect to an adjustment operation of the voltage applied to a transfer roller from a transfer power supply.
Figure 5A:
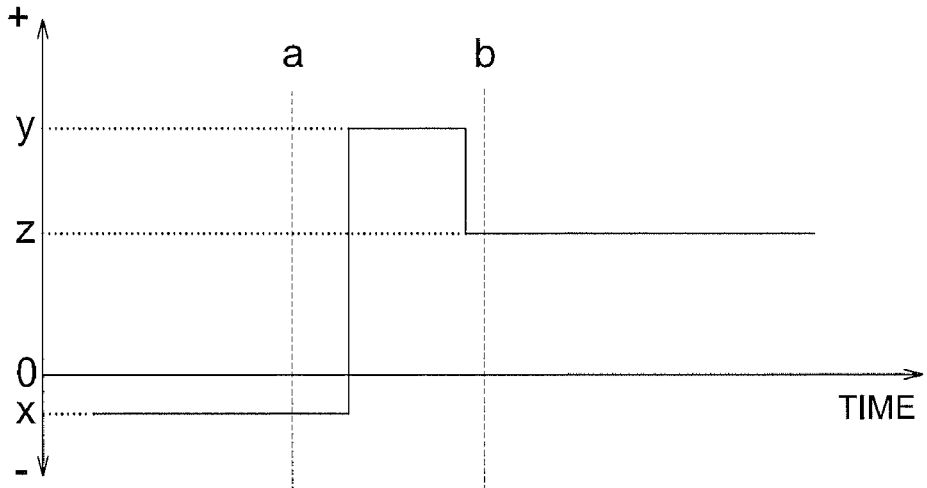
FIGS. 5(*a*) and 5(*b*) illustrate time charts at the time of executing the adjustment operation illustrated in FIG. 4.
Figure 5B:
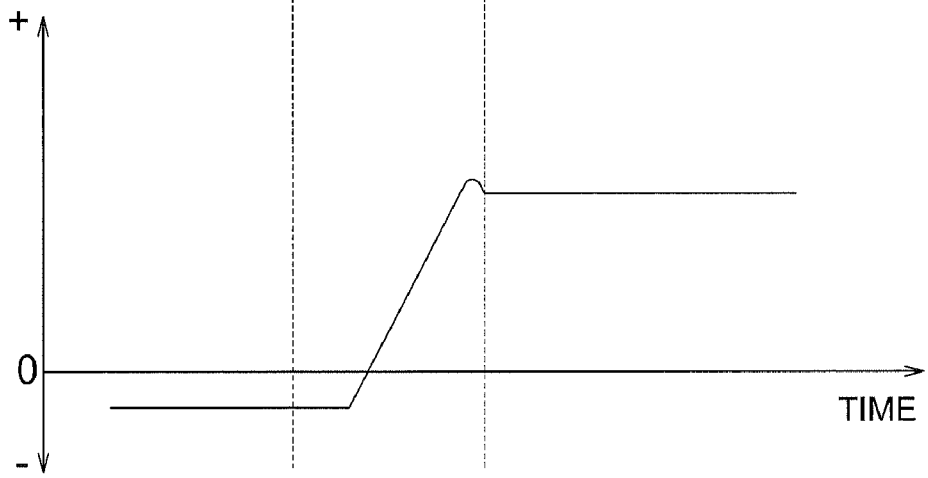

FIG. 4 is a flow chart drawing with respect to the adjustment operation of the voltage applied to the transfer roller 54 from the transfer power supply CH, and FIGS. 5(*a*) and 5(*b*) are time chart drawings at the time of executing the adjustment operation shown in FIG. 4. FIG. 5*a* is a time chart drawing of the voltage applied to the transfer roller 54, and FIG. 5*b* is a time chart drawing of an electric field which is generated between the transfer roller 54 and the photoreceptor 41. "a" in FIGS. 5*a* and 5*b* shows a time when the conveyance direction leading edge of the sheet S has advanced into the transfer nip portion N1, and "b" in FIGS. 5*a* and 5*b* shows a time when an imaging area on the sheet S has advanced into the transfer nip portion N1. Therefore, the time before "a" in FIGS. 5*a* and 5*b* is the time when the sheet S is not placed between the transfer nip portions N1. The time between "a" and "b" is the time when the non image area in the sheet S has passed the transfer nip portion N1. The time after "b" is the time when an imaging area on the sheet S are passing through the transfer nip portion N1.

Firstly, the adjustment operation of the voltage applied to the transfer roller 54 will be explained based on FIG. 4. When a job with respect to the image formation starts in the image forming apparatus A, before the sheet S advances into the transfer nip portion N1, the photoreceptor 41 and the transfer belt 51 will contact and rotate. In this case, in order to prevent the toner which remains on the non image area of the photoreceptor 41 from being transferred to the transfer belt 51, the control section 100 controls the transfer power supply CH, and applies voltage having an opposite polarity (an embodiment of the present invention: minus polarity) which is opposite to a transfer polarity (an embodiment of the present invention plus polarity) to the transfer roller 54 (STEP S1). When showing the state of STEP S1 in FIG. 5*a*, before the sheet S advances into the transfer nip portion N1 (time before "a" in FIGS. 5*a* and 5*b*), voltage x which is a minus polarity will be applied to the transfer roller 54.

Thus, by applying voltage having a polarity which is opposite to the transfer polarity, i.e., the same polarity as the toner to the transfer roller 54, the toner of the photoreceptor 41 is not transferred onto the transfer belt 51, and the transfer belt 51 does not become dirty. Particularly, in case of forming a patch image for image adjustment in a non image area of the photoreceptor 41, it is effective in order not to transfer the patch image onto the transfer belt 51.

As shown in FIG. 5*a*, when the voltage having the polarity which is an opposite polarity to the transfer polarity is applied to the transfer roller 54 at STEP S1 shown in FIG. 4, the voltage having the polarity which is opposite to the transfer polarity is applied to the transfer roller 54 until a predetermined non image area in the sheet S has passes through the transfer nip portion N1 (time to switch to the maximum voltage y from a voltage x in FIGS. 5*a* and 5*b*), after the conveyance direction leading edge of the sheet S advances into the transfer nip portion N (time of "a" of FIGS. 5*a* and 5*b*).

Thus, when voltage having the polarity which is opposite to the transfer polarity is applied to the transfer roller 54 and the direction of the electric field is arranged to be heading to the direction of the transfer roller 54 from the photoreceptor 41 in the conveyance direction leading edge of sheet S, even if there is a burr at the conveyance direction leading edge of the sheet S and electric discharge occurs in an opening between the transfer belt 51 and the sheet S, the conveyance direction leading edge of sheet S is charged in the same polarity as the photoreceptor 41. As a result, the leading edge of the sheet S repulses the photoreceptor 41, the leading edge of the sheet S departs from the photoreceptor 41 and poor separation that the sheet S winds around the photoreceptor 41 ceases to occur.

Next, an operation switched to the voltage of the transfer polarity side after applying the voltage having a polarity which is an opposite polarity to the transfer polarity will be explained.

As shown in FIG. 5*a*, the voltage having a polarity which is an opposite polarity to the transfer polarity is applied to the transfer roller 54 after the conveyance direction leading edge of the sheet S advances into the transfer nip portion N1 until a predetermined non image area passes through the transfer nip portion N1, as shown in FIG. 5*a*. However, proper transfer is not performed unless a proper transfer electric field is formed when an imaging area of the sheet S advances into transfer nip portion N1. Therefore, the density of a toner image to be transferred onto the sheet S cannot be fully secured. Then, in order to immediately form a proper transfer electric field, it is designed that the voltage is switched from the voltage having a polarity which is an opposite polarity to the transfer polarity to the voltage having a polarity which is in the transfer polarity side.

The above process will be explained below using FIG. 4. The sheet detection sensor SE in an upstream side of the transfer nip portion N1 detects the sheet S (refer to FIG. 2). When the sheet S is detected by the sheet detection sensor SE (STEP S2; Yes), a timer installed in the image forming apparatus A will be started (STEP S3). A time is measured after starting a timer until T1 (time) passes. T1 is a predetermined time for switching to voltage in the transfer polarity side from the voltage having a polarity which is opposite to the transfer polarity. When it is determined that T1 has passed at STEP S3, it will be switched to the maximum voltage y which is the voltage in the transfer polarity side (STEP S5).

As shown in FIG. 5*a*, the timing switched to the maximum voltage y from the voltage x is in between "a" and "b" of FIGS. 5*a* and 5*b*. That is, the timing is the time within which the non image area in the sheet S passes through the transfer nip portion N1. The voltage is switched at such time because a proper transfer electric field needs to be formed when the imaging area in the sheet S advances into the transfer nip portion N1.

Even though voltage is switched at such time, since voltage x of a minus polarity is applied to the transfer roller 54 after the conveyance direction leading edge of the sheet S advances into the transfer nip portion N1 until a predetermined non image area passes through the transfer nip portion N1, poor separation of sheet S is not generated.

Since an absolute value of the maximum voltage y switched from the voltage x of minus polarity is larger than an absolute value of the transfer voltage z applied to the transfer roller 54 when transferring a toner image of photoreceptor 41 onto the sheet S, as shown in FIG. 5 (*b*), it can be immediately returned to a proper transfer electric field.

After switching to the maximum voltage y at STEP S5, it is measured whether T2 (time) has passed by the timer installed in the image forming apparatus A (STEP S6). When it is determined that T2 has passed at STEP S6, the voltage will be switched to the transfer voltage z from the maximum voltage y (STEP S7).

As shown in FIG. 5*a*, the voltage is switched to the transfer voltage z before "b" which is a time of an imaging area in the sheet S advancing into the transfer nip portion N1. Based on this process, as shown in FIG. 5*b*, when the imaging area in the sheet S advances into the transfer nip portion N1, a proper transfer electric field can be formed, and the density of a toner image transferred onto the sheet S can fully be secured.

In order to apply the voltage x having a polarity which is opposite to the transfer polarity after finishing the transfer to the sheet S again after switching to the transfer voltage z at STEP S7, whether T3 (time) has passed is measured by the timer installed in the image forming apparatus A (STEP S8). When it is determined that T3 has passed at STEP S8, the voltage will be switched to voltage x having a polarity which is opposite to the transfer polarity from the transfer voltage z (STEP S9), and the timer will be reset (STEP S10). Thus, if voltage x having a polarity which is opposite to the transfer polarity is set, the toner of the photoreceptor 41 will not be transferred to the transfer belt 51, and the transfer belt 51 will not become dirty.

As long as there is a following sheet in a job with respect to image formation, operations of STEPs S2-S10 will be executed.

Voltage having a polarity which is opposite to the transfer polarity is applied to the transfer roller 54 before a predetermined non image area in the sheet S has passed through the transfer nip portion N2 since before the conveyance direction leading edge of the sheet S advances into the transfer nip portion N1 as explained using FIGS. 4, 5*a* and 5*b* above. Then, while the non image area in the sheet S passes the transfer nip portion N2, the voltage is switched to the voltage (the maximum voltage y) in the transfer polarity side from the voltage of the opposite polarity, and it is applied to the transfer roller 54. Thereby, poor separation of sheet S can be prevented and a density of a toner image which is transferred onto the sheet S is fully secured.

Particularly as for the photoreceptor 41 of a drum shape as shown in FIGS. 1 and 2, the diameter tends to become larger to improve the speed of the apparatus and to improve durability. Therefore it is difficult to separate a sheet using curvature as compared with a belt-shaped image carrier which can freely set up the curvature in the transfer section. Then, it is effective to apply the present invention in a transfer device and an image forming apparatus which have drum-shaped image carriers (a photoreceptor drum, a transfer drum, etc.).

[Adjustment of a Timing of Application of Transfer Voltage]

Next, the timing of the application of the voltage applied to the transfer roller 54 by transfer power supply CH will be explained. As explained in FIGS. 4, 5*a* and 5*b*, the voltage of polarity opposite to the polarity of transference is applied to the transfer roller 54 since before the conveyance direction leading edge of the sheet S advances into the transfer nip portion N1 until before a predetermined non image area in the sheet S has passed through the transfer nip portion N2 as explained using FIGS. 4, 5*a* and 5*b* above. As a result, the direction of the electric field becomes a direction from the photoreceptor 41 to the transfer roller 54, and the poor separation of the sheet S can be prevented. Further, after that, when the voltage is switched to a voltage of the transfer polarity side from the voltage of the opposite polarity, the transfer voltage can be quickly recovered and the density of the toner image which is transferred onto the sheet S is fully secured.

However due to a variation of the rotation speed of the registration roller RG (refer to FIG. 2), when the timing when the sheet S advances into the transfer nip section N1 shifts, even if the voltage is applied to the transfer roller 54 at initial timings of T1 and T2, the voltage can not be applied at an appropriate timing, and it is possible that the poor separation of the sheet S can not be prevented or the density of the toner image which is transferred onto the sheet S is not fully secured.

Figure 6A:
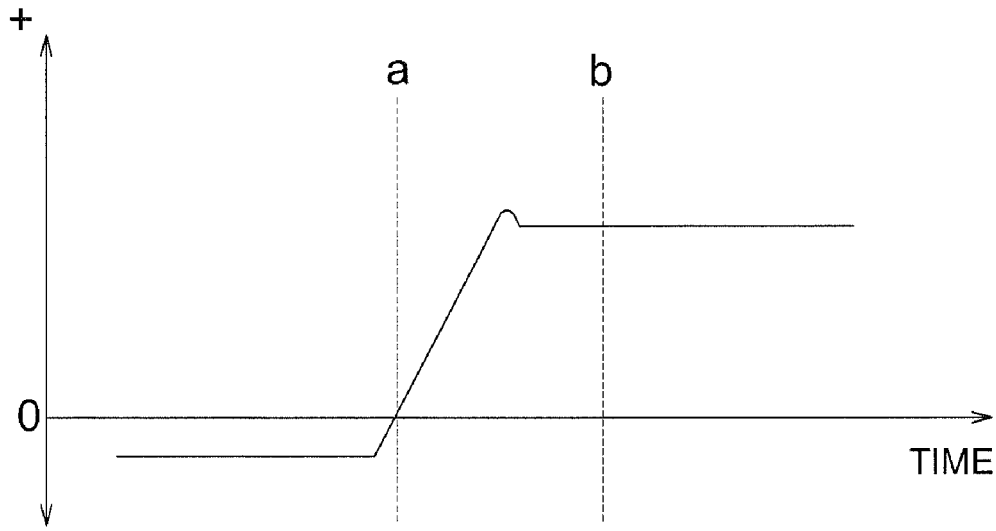
FIGS. 6(*a*) and 6(*b*) illustrate time charts of electric field generating between the transfer roller and the photoreceptor.
Figure 6B:
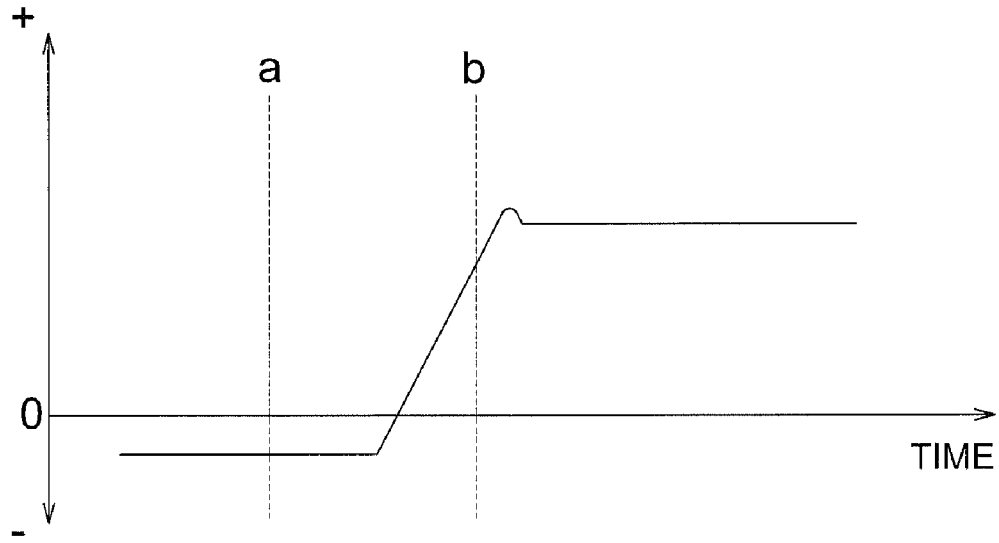

FIGS. 6*a* and 6*b* describe time charts drawing of an electric field which is generated between the transfer roller 54 and the photoreceptor 41, Similar to FIG. 5*b*. For example, when the voltages are applied to the transfer roller 54 at the timings T1 and T2 shown in FIG. 4 in a state where the timing when the sheet S advance into the transfer nip section N1 is delayed due to the variation of the rotation speed of the registration roller RG and so on, as shown in FIG. 6*a*, the voltage is switched from the voltage of opposite polarity to the transfer polarity to the voltage of the transfer polarity before the timing when the leading edge of the sheet S advances into the transfer nip section N1 ("a" in FIG. 6*a*), it is possible that the poor separation of the sheet S can not be prevented. Further, when the voltages are applied to the transfer roller 54 at the timings T1 and T2 shown in FIG. 4 in a state where the timing when the sheet S advance into the transfer nip section N1 is advanced due to the variation of the rotation speed of the registration roller RG and so on, as shown in FIG. 6*b*, the appropriate voltage of the transfer polarity is not recovered at the timing when the leading edge of the sheet S advances into the transfer nip section N1 ("a" in FIG. 6*a*), it is possible that the density of the toner image which is transferred onto the sheet S is not fully secured.

Further, even when the voltage is switched to the voltage of the transfer polarity side from the voltage of the opposite polarity, the appropriate voltage of the transfer polarity is not recovered at an appropriate timing due to a performance of the transfer power supply CH. As a even when the voltage is applied at the timings T1 and 12, the appropriate voltage is not recovered when the image area of the sheet S advances into the transfer nip section N1, and it is possible that the density of the toner image which is transferred onto the sheet S is not fully secured.

So, by considering the variation of the rotation speed of the registration roller RG and the performance of the transfer power supply CH, the timing when the voltages are applied to the transfer roller 54 from the transfer power supply CH is adjusted. More specifically, the adjustment of timing of supplying the transfer voltage is performed by changing timings T1, T2, and T3 shown in FIG. 4.

The preferable amounts of the changing values of T1, T2, and T3 are judged by using a sheet S for measurement which was outputted by the image forming apparatus A. The details of this point is explained after here.

When the sheet S for measurement was outputted, the charging section 42, the exposure section 43, the development section 44 are used and a solid toner image is formed over an area including an area which is normally an non image area. On the other hand, the voltage applied to the transfer roller 54 from the transfer power supply CH is applied as explained at FIGS. 4, 5*a* and 5*b*. When the sheet S for measurement is outputted like this way, the solid image on the photoreceptor 41 which is formed at the non image area poorly transferred and comes on the sheet S for the measurement, because the voltage shown in the FIGS. 4, 5*a*, and 5*b* is applied to the transfer roller 54 at the non image area at the leading edge side in the conveyance direction of the sheet S (That is, a voltage other than the transfer voltage z shown in FIG. 5*a* is applied to the non image area).

Figure 7:
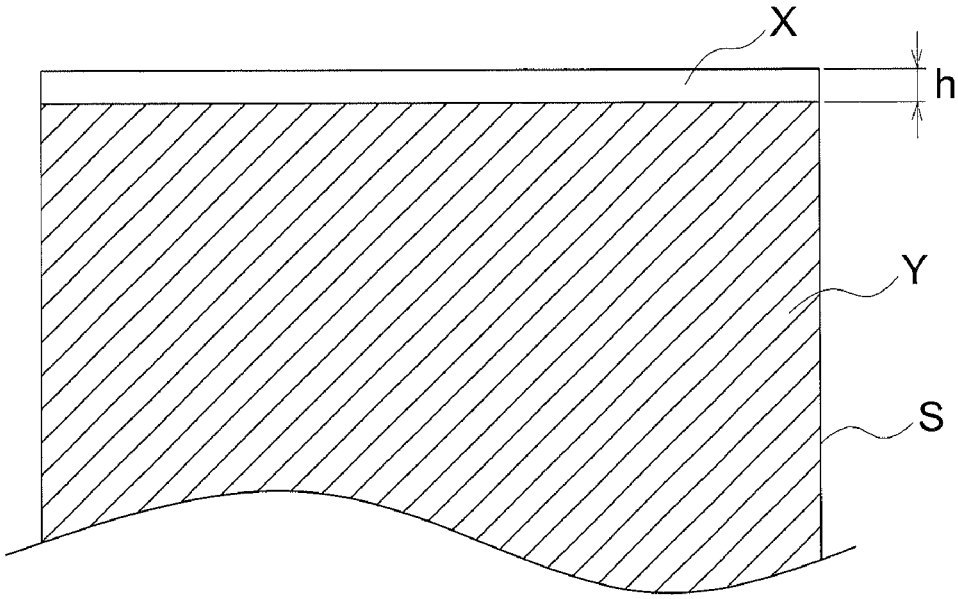
FIG. 7 illustrates a pattern diagram of a sheet for a measurement.
Figure 8:
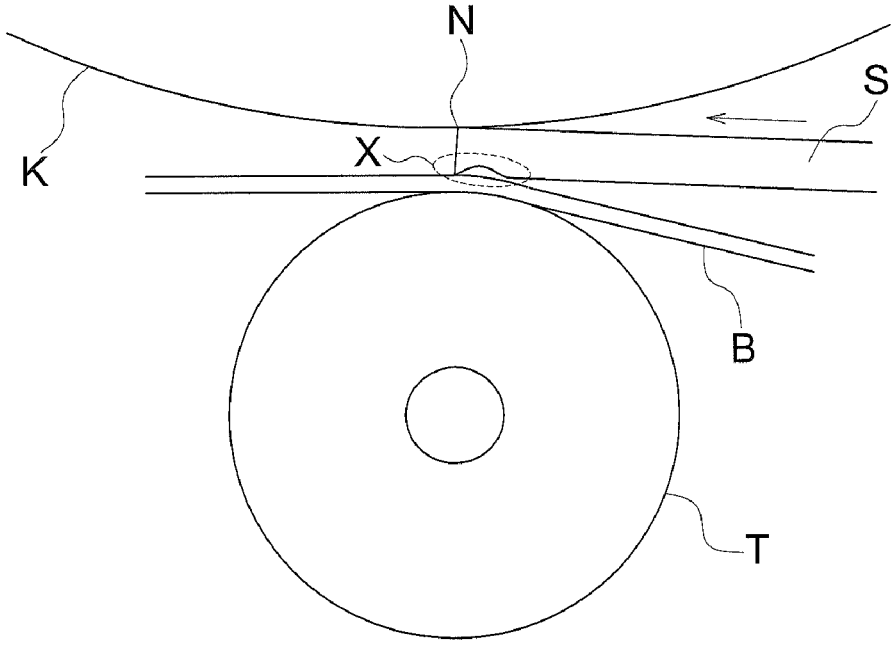
FIG. 8 illustrates an explanatory view showing a transfer area of a contact transfer system.

A pattern diagram of the sheet S for the measurement is shown in FIG. 7. The area X in which the poor transference of the solid image comes out exists at the leading edge side of the sheet S, a properly transferred solid image is formed at the other area Y. In the embodiment shown in the FIGS. 4, 5*a* and 5*b*, the none image area of the leading edge side in the conveyance direction of the sheet S is set to 3 mm, and a voltage may be applied at the timings T1, T2, and T3 as explained in FIGS. 4, 5*a* and 5*b*, because the variation of the rotation speed of the registration roller RG does not occur in case when a length of the area X of the sheet S is 3 mm. On the other hand, the timings T1, T2, and T3 need to be changed in respect to the poor separation, because the length of the non image area which is set does not keep as set, due to the variation of the rotation speed of the registration roller RG, in case when a length h of the area X of the sheet S is other than 3 mm.

To which value the T1, T2 and T3 which are initial values are changed is decided by the timing deciding section 106 (refer to FIG. 3). The length h of the area X of sheet S for measurement shown in FIG. 7 is measured by a user, and the user input the measured value through the operation display section 2. The timing deciding section 106 decides changed values such as T1 based on a table which predetermines a relation between the input values and changed values such as T1.

Specifically, if the input value is 3 mm, the timing deciding section 106 does not change T1, T2, and T3, and the voltage explained in FIGS. 4, 5*a* and 5*b* according to the initial values is applied to the transfer roller 54 as it is. If the input value is less than 3 mm, the timing deciding section decides that the timing when the sheet S advances into the transfer nip section N1 becomes delayed and values T1 T2, and T3 are larger than initial values and the timing deciding section changes them to the values in responding to the values input through the operation display section 2. If the input value is larger than 3 mm, the timing deciding section decides that the timing when the sheet S advances into the transfer nip section N1 becomes advanced and values T1, T2, and T3 are smaller than initial values and the timing deciding section changes them to the values in responding to the values input through the operation display section 2.

Further, in case when the timing deciding section decides that T1, T2, and T3 need to be changed, the timing deciding section replaces T1, T2, and T3 in the flow chart of FIG. 4 with changed values T1', T2', and T3' and the control section 100 control the transfer power supply based on the timings T1', T2', and T3' and supply voltages explained in FIGS. 4,5*a*, and 5*b* with the timings T1', T2', and T3'.

When the control is performed as this way, even if the timing when the sheet S advances into the transfer nip section N1 shifts, the voltage of opposite polarity to the transfer polarity is applied to the transfer roller 54 since before the leading edge of the sheet S advances into the transfer nip section N1 until before the predetermined non image area has passed through as shown in FIGS. 5*a* and 5*b*, then the applied voltage is switched to the voltage of the transfer polarity (the maximum voltage y) from the voltage of the opposite polarity and is applied to the transfer roller 54, while the non image part of the sheet S pass through the transfer nip section N2.

In the embodiment explained above, the operation of changing the values such as T1 is performed by the operation of inputting the length h of the area X by the user at the operation display section 2 by outputting the sheet S for to measured. The operation of changing the values of T1 and so on is not limited to this. For example, the image reading section 1 reads the sheet S to be measured, the length h of the area X at the sheet to be read is measured at the side of the image forming apparatus by the read image information, and the determining section 106 may determine whether the values of T1 and so on is changed, or not. Further a reading sensor may be provided at a down stream side in respect to the nip section N1, the length h of the area X at the sheet to be read at the image forming apparatus side may be measured by using the reading sensor, and the determining section 106 may determine whether the values of T1 and so on is changed, or not. Further a service person may directly input the changing the values such as T1 through the operation display section 2, the timing deciding section 106 may decide the changing values as the changed value.

As explained above, the timing deciding section 106 decides changed values of T1, T2 and T3 which are timings for applying transfer voltage, by considering the shifts of rotation speeds of the registration roller RG and the performance of the transfer power supply CH. In a period since a leading edge of the sheet S in a conveyance direction advances into the nip portion until a predetermined non image area of the sheet S has passed through the nip portion, the control section 100 controls the application section to apply a voltage having an opposite polarity to a transfer polarity to the transfer section onto the transfer roller 54 until the timing determined by the determining section 106, and then, at a timing determined by the determining section 106, switch to apply a voltage having the transfer polarity from the voltage having the opposite polarity to the transfer section onto the transfer roller 54 while the non image area of the sheet passes through the nip portion. Through doing this, poor separation of a sheet can be prevented and density of a toner image to be transferred onto a sheet is fully securable, even when the timing when the sheet S advances into the nip section N1 shifts.

The present invention is not limited to the embodiment, and although there are changes and an additions in the scope of the present invention which does not depart from the gist of the present invention, it will be contained in the present invention.

The determining whether the adjustment operation in FIG. 4 is executed or not according to the type of a sheet S may be executed. For example, in case when the type of the sheet S is a type of a sheet with which poor separation tends to occur, the adjustment operation shown in FIG. 4 may be executed and the adjustment operation shown in FIG. 4 may not be executed in the case when the sheet is a sheet thicker than a predetermined thickness or a coated paper with which poor separation does not easily occur.

Whether the adjustment operation in FIG. 4 is executed or not may be determined according to the image information to be formed on the sheet S. For example, since poor separation is hard to occur although the sheet S has a burr in case when the image is an image to be formed up to an area at the leading edge in the conveyance direction of the sheet S, the adjustment operation in FIG. 4 may not be executed.

It may be determined whether adjustment operation in FIG. 4 is executed by detecting whether a burr exists or not, or by detecting the direction of a burr in a sheet.

According to the transfer device, the image forming apparatus, and the control method related to the embodiments of the present invention, poor separation of a sheet can be prevented and density of a toner image to be transferred onto a sheet is fully securable.

What is claimed is:

1. A transfer device comprising:

a transfer section which forms a nip portion between the transfer section and an image carrier and transfers a toner image on an image carrier onto a sheet passing through the nip portion;

an application section which applies a voltage to the transfer section;

a determining section which comprises an adjusting section for adjusting a parameter for adjusting a timing of applying voltage from the application section to the transfer section and determines the timing in accordance with the parameter; and a control section which controls the application section, wherein the control section controls the application section to apply a voltage having an opposite polarity to a transfer polarity to the transfer section until the timing determined by the determination section in a period since a leading edge of the sheet in a conveyance direction advances into the nip portion until a predetermined non image area of the sheet has passed through the nip portion, and then, at a timing determined by the determining section, switch to apply a voltage having the transfer polarity from the voltage having the opposite polarity to the transfer section while the non image area of the sheet passes through the nip portion.

2. The transfer device described in claim 1, wherein an absolute value of the voltage having the transfer polarity is larger than an absolute value of a voltage which is applied to the transfer section when the toner image on the image carrier is transferred to the sheet.

3. The transfer device described in claim 1, wherein the parameter is manually inputted by an operator to adjust a shift amount of the timing.

4. The transfer device described in claim 1, wherein the parameter is automatically calculated based on a measured value of a quantity of a conveyance shift including a conveyance shift of a registration roller.

5. The transfer device described in claim 4 comprising a sheet detection sensor, wherein the parameter is automatically calculated based on the measured value detected by the sheet detection sensor.

6. The transfer device described in claim 1, wherein the control section changes the control of the application section according to a type of the sheet.

7. The transfer device described in claim 1, wherein, in case when the sheet is a coated sheet or a sheet thicker than a predetermined thickness which are sheets with which poor separation from the image carrier does not easily occur, the adjusting the timing is not performed.

8. The transfer device described in claim 1, wherein, in case when an image information for the toner image is an image which hardly causes the sheet a separation error from the image carrier, the adjusting the timing is not performed.

9. The transfer device described in claim 8, wherein the image which hardly causes the sheet a separation error from the image carrier is an image which spreads up to an leading edge area of the sheet.

10. An image forming apparatus comprising:

an image forming device which visualizes an electrostatic latent image on the image carrier by developing agent;

the transfer device described in claim 1; and a fixing device which fixes the toner image transferred by the transfer device onto the sheet.

11. A control method of a transfer device which comprises a transfer section for transferring a toner image on an image carrier onto a sheet passing through a nip portion which is formed between the transfer section and the image carrier and an application section for applying voltage to the transfer section, the control method comprising:

adjusting a parameter of a timing of applying voltage from the application section to the transfer section;

determining the timing in accordance with the parameter;

controlling the application section to apply a voltage having an opposite polarity to a transfer polarity to the transfer section since a leading edge of the sheet in a conveyance direction advances into the nip portion until a predetermined non image area of the sheet has passed through the nip portion; and then controlling the application section to switch to apply a voltage having the transfer polarity from the voltage having the opposite polarity, at a timing determined, while the non image area of the sheet passes through the nip portion.

12. The control method of a transfer device described in claim 11, wherein an absolute value of the voltage having the transfer polarity is larger than an absolute value of a voltage which is applied to the transfer section when the toner image on the image carrier is transferred to the sheet.

13. The control method described in claim 11, wherein the parameter is manually inputted by an operator to adjust a shift amount of the timing.

14. The control method described in claim 11, wherein the parameter is automatically calculated based on a measured value of a quantity of a conveyance shift including a conveyance shift of a registration roller.

15. The control method described in claim 14, wherein the transfer device comprises a sheet detection sensor and the parameter is automatically calculated based on the measured value detected by the sheet detection sensor.

16. The control method described in claim 11, comprising changing the control of the application section according to a type of the sheet.

17. The control method described in claim 11, wherein, in case when the sheet is a coated sheet or a sheet thicker than a predetermined thickness which are sheets with which poor separation from the image carrier does not easily occur, the control method comprises applying the voltage which is applied to the transfer section when the toner image on the image carrier is transferred to the sheet, since the leading edge of the sheet advances into the nip portion.

18. The control method described in claim 11, wherein the adjusting timing is not performed when an image information for the toner image is an image which hardly causes the sheet a separation error from the image carrier.

19. The control method described in claim 17, wherein the image which hardly causes the sheet a separation error from the image carrier is an image which spreads up to an leading edge area of the sheet.

* * * * *